United States Patent [19]

Röck et al.

[11] 4,323,213

[45] Apr. 6, 1982

[54] SUSPENSION FITTING FOR CABINETS

[75] Inventors: Erich Röck; Josef Brunner, both of Höchst, Austria

[73] Assignee: Julius Blum Gesellschaft m.b.H., Höchst, Austria

[21] Appl. No.: 206,854

[22] Filed: Nov. 6, 1980

[30] Foreign Application Priority Data

Nov. 19, 1979 [AT] Austria ..... 7340/79

[51] Int. Cl.[3] ..... E04G 5/06

[52] U.S. Cl. ..... 248/222.1; 248/225.2

[58] Field of Search ..... 248/222.1, 223.3, 223.4, 248/224.1, 224.2, 224.4, 225.1, 225.2, 495; 312/249, 246

[56] References Cited

U.S. PATENT DOCUMENTS

| | | | |
|---|---|---|---|
| 1,621,767 | 3/1927 | Capra | 74/53 |
| 1,716,122 | 6/1929 | Gilmand | 74/53 UX |
| 1,921,897 | 8/1933 | Topham | 74/53 UX |
| 3,791,709 | 2/1974 | Cross | 248/496 X |

FOREIGN PATENT DOCUMENTS

| | | | |
|---|---|---|---|
| 43935 | 7/1974 | Australia | 248/225.2 |
| 2820085 | 11/1979 | Fed. Rep. of Germany | 248/225.2 |
| 2344252 | 11/1977 | France | 248/225.2 |
| 128536 | 6/1950 | Sweden | 248/220.2 |
| 1408687 | 10/1975 | United Kingdom | 248/225.2 |

*Primary Examiner*—J. Franklin Foss

*Attorney, Agent, or Firm*—Wenderoth, Lind & Ponack

[57] ABSTRACT

A suspension fitting for cabinets to be hung on a wall includes a supporting member which is fastened to the piece of furniture and a suspension member displaceably mounted in the supporting member and adapted to rest in a hook in the wall. A disc with a spirally extending member is provided for displacing the suspension member.

The fitting is mounted on the outside of the cabinet directly at the rear wall and is elongated vertically.

5 Claims, 6 Drawing Figures

SUSPENSION FITTING FOR CABINETS

BACKGROUND AND FIELD OF THE INVENTION

This invention relates to a suspension fitting for pieces of furniture with a supporting member adapted to be fastened to the body of the piece of furniture and a vertically aligned hook member adjustably mounted in the supporting member, the hook member resting in mounted position against a suspension rail or the like fastened to a wall, adjusting means for the vertical adjustment of the hook member being provided on the supporting member.

DESCRIPTION OF THE PRIOR ART

Such suspension fittings are used to fasten a cabinet or the like to the wall of a room.

An adjustment of the position of the piece of furniture should be possible by means of such suspension fittings so that inaccuracies which may have been caused when mounting the fastening hook on the side of the wall or a fastening rail can be eliminated.

An adjustment in the height of the piece of furniture is required above all.

It is essential that the adjustment means are of compact design and that no clamping effects are created by the weight of the cabinet or the like.

Suspension fittings should generally be designed in such a manner that they require minimum space in the cabinet or the like.

SUMMARY OF THE INVENTION

It is, therefore, the object of the present invention to provide a suspension fitting of the above-mentioned type and including adjusting means for vertical adjustment, such means requiring minimum space and being secured from being jammed.

In accordance with the present invention this is achieved by providing the adjusting means for vertical adjustment in the form of a disc rotatably mounted in the supporting member, the disc comprising a spiral supporting wall for the hook member, the upper end of the hook member bearing against the supporting wall.

A further embodiment of the invention provides that at least one supporting tooth or the like associated with the hook member extends into a spiral groove in the disc.

A further embodiment provides that the disc is provided with a spiral projection, at least one supporting tooth associated with the hook member resting against the projection, the hook member preferably being provided with a toothed rack or being connected with such rack, the teeth of the rack resting against the spiral projection.

By rotating the disc, the teeth and the hook member are moved vertically.

It is preferably provided that the teeth are bent in their cross-sections.

The disc is mounted in a simple and compact manner by providing the supporting member with a plate arranged parallel to the rear wall of the piece of furniture, the plate having a hole in which a pin of the disc is mounted.

A further embodiment preferably provides that an adjusting screw for the depth adjustment of the hook member is mounted in the plate.

BRIEF DESCRIPTION OF THE DRAWINGS

In the following two embodiments of the invention will be described in greater detail with reference to the accompanying drawings, without being limited thereto, and in which.

DESCRIPTION OF THE PREFERRED EMBODIMENTS

The suspension fitting in accordance with the present invention comprises a frame-like supporting member 11 fastened to a top panel 1 and to a furniture side wall by means of screws 14 or the like.

Figure 1:
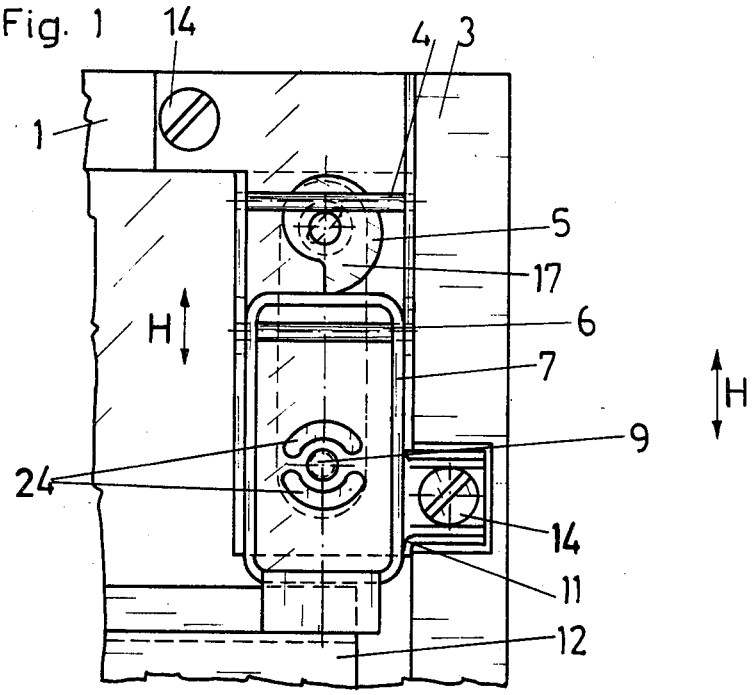
FIG. 1 is a rear view of the rear wall of a piece of furniture with a suspension fitting in accordance with the present invention.
Figure 2:
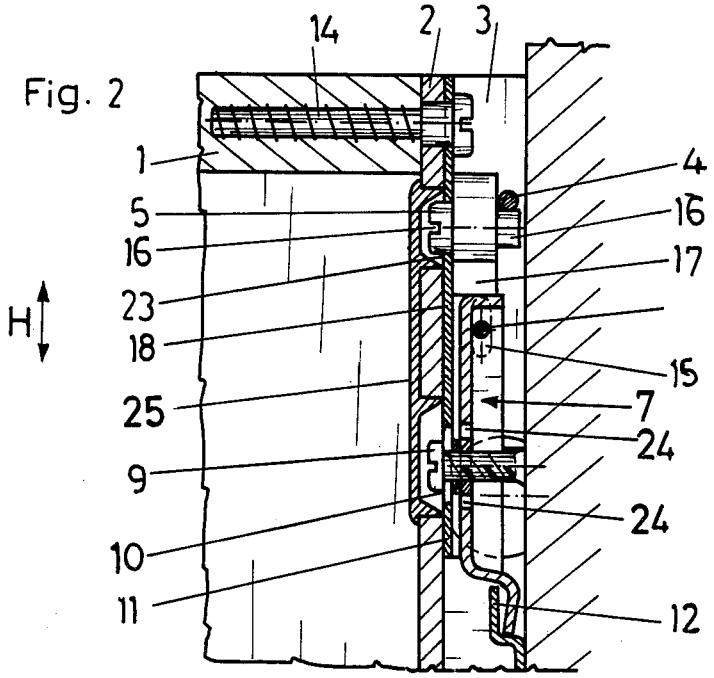
FIG. 2 is a sectional view through FIG. 1, showing a cabinet resting directly on a wall.
Figure 3:
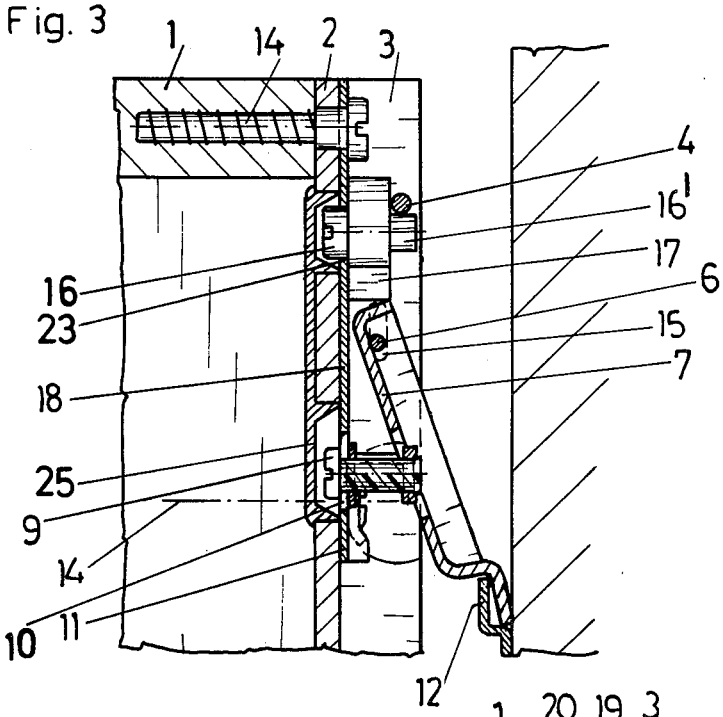
FIG. 3 is a sectional view similar to FIG. 2, but with a cabinet spaced from the wall.
Figure 4:
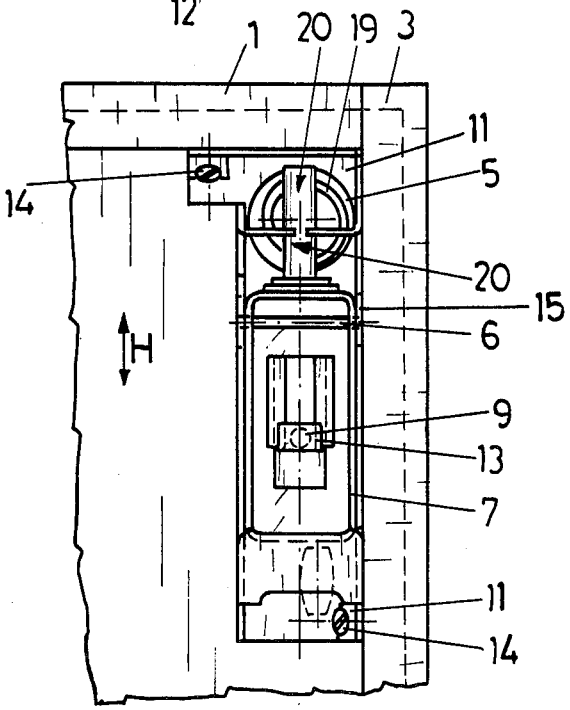
FIG. 4 is a view similar to FIG. 1, but of a further embodiment of the suspension fitting in accordance with the present invention.
Figure 5:
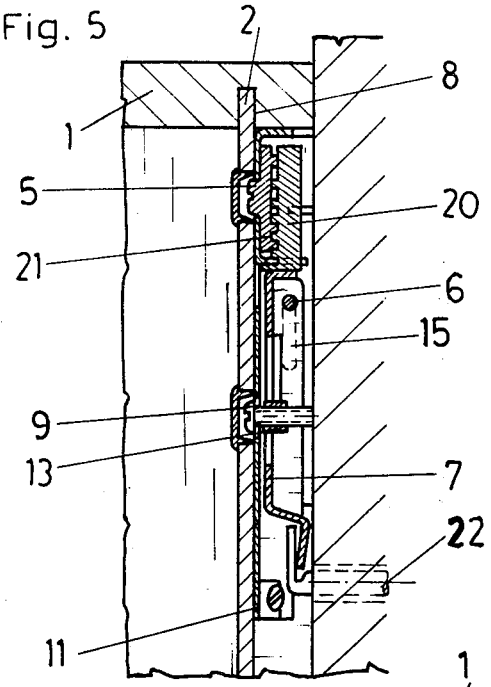
FIGS. 5 and 6 are sectional views through FIG. 4, the cabinet lying close to the wall in FIG. 5 and spaced from the wall in FIG. 6.
Figure 6:
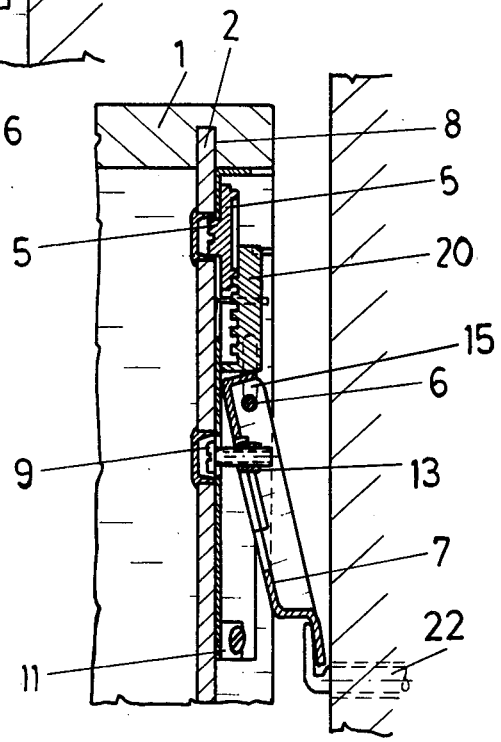

The supporting member 11 rests immediately on the rear wall 2 of the piece of furniture. The fastening screw 14 can either, as illustrated in FIGS. 1 to 3, be screwed into rear faces of the top panel 1 and the side wall 3 of the piece of furniture or, as illustrated in FIGS. 4 to 6, into the inner side faces thereof. A hook-shaped suspension member 7 is displaceably mounted in the frame-like supporting member 11 and is retained therein by a positioning pin 6 extending through two slots 15 in the supporting member 11 and by a screw 9, by which also adjustment of the fitting in the direction of the depth of the piece of furniture is effected.

In the embodiment illustrated in FIGS. 1 to 3, the upper end of the hook member 7 abuts against the rim or periphery of a disc 5.

The disc 5 is mounted in a hole 23 in a plate 18 of the supporting member 11 by means of a pin 16.

The pin 16 can be moulded in one piece with the disc 5, it can, however, also be an individual part.

On the side of the disc 5 directed towards the wall, a pin 16' bears against a supporting pin 4 mounted on the supporting member 11.

The disc 5 has a spiral periphery, forming a projection 17 defining a step.

The periphery of the disc 5 rests on the upper end of hook member 5.

On the side directed towards the wall, the hook member 7 is mounted in a suspension rail 12. By rotating the disc 5, the supporting member 11 is moved in the direction of double arrow H with respect to the hook member 7, thus effecting a vertical adjustment of the position of the cabinet.

A side adjustment is effected by moving the cabinet and, thus, the hook member 7 along the suspension rail 12.

The screw 9 for depth adjustment is mounted in the lower region of the plate 18, screw 9 being fixed to the plate 18 by means of a toothed disc 10 and engaging the hook member 7 by suitable means, e.g. by means of a slide block 13 (FIGS. 4–6) or engaging a flexible region of the hook member 7 defined by punched portions 24 (FIGS. 1–3).

The screw 9 and the pin 16 can be reached through holes in the rear wall 2 of the piece of furniture, such holes being covered by a cap 25.

In the embodiment illustrated in FIGS. 4 to 6, the disc 5 is provided with a spirally extending projection 19. Teeth 21 of a tooth rack 20 bear against and mesh with projection 19, rack 20 being connected to the hook member 7.

By rotating the disc 5, the spiral projection moves the the rack 20 and, hence, the hook member 7 in the direction of double arrow H.

An adjusting screw 9 for the depth adjustment is provided as in the afore-described embodiment. The hook member 7 can be moved by screw 9 in directions towards and away from the supporting member 11.

In the embodiment illustrated in FIGS. 4–6, the supporting member 11 is arranged at the outside of the cabinet directly at the rear wall 2 and at the top panel 1 of the piece of furniture.

The rear wall 2 of the piece of furniture is spaced from the rear face of the top panel 1 and is inserted into a groove 8 of top panel 1 of the piece of furniture. At the wall the hook member 7 is mounted in a hook 22.

What is claimed is:

1. A suspension fitting for mounting a piece of furniture on a wall, said fitting comprising:

a supporting member adapted to be fastened to a body of a piece of furniture, said supporting member including a plate adapted to extend generally parallel to the plane of a wall of the body of the piece of furniture, said plate having wherein a hole;

a hook member mounted on said supporting member for relative vertical movement therebetween, said hook member having at a lower portion thereof means for mounting said hook member, and thereby said supporting member and the piece of furniture, in a mounted position in a suspension rail to be fastened to a wall;

means for adjusting the relative vertical position of said supporting member with respect to said hook member, said vertical adjusting means comprising a disc having a pin rotatably positioned in said hole in said plate of said supporting member, said disc having extending therefrom, on a side thereof opposite said pin, a spiral projection, a rack having teeth meshing with said spiral projection, said rack having a lower portion in engagement with an upper portion of said hook member, such that rotation of said disc with respect to the center of said hole causes said spiral projection to move said disc, and thereby said supporting member, vertically relative to said rack and said hook member; and means for adjusting the position of the piece of furniture in the direction of the depth of the piece of furniture, said depth adjusting means comprising an adjusting screw extending through said plate of said supporting member and threaded into a threaded portion of said hook member, whereby rotation of said adjusting screw causes relative movement in said direction of depth between said hook member and said supporting member.

2. A fitting as claimed in claim 1, wherein said supporting member has therein a pair of laterally spaced, vertically extending slots, and said hook member has extending laterally from opposite sides thereof pin portions extending into said slots, said pin portions mounting said hook member to said supporting member and enabling limited relative vertical movement therebetween.

3. A fitting as claimed in claim 1 or claim 2, wherein said threaded portion of said hook member comprises a slide block mounted for relative vertical displacment in said hook member.

4. A fitting as claimed in claim 1 or claim 2, wherein said threaded portion of said hook member comprises a flexible region of said hook member capable of deformation with respect to the plane of said hook member.

5. A fitting as claimed in claim 1, wherein said mounting means at said lower portion of said hook member comprises an outwardly offset and downwardly extending portion.

* * * * *